US010275980B1

(12) United States Patent
Heathcote et al.

(10) Patent No.: US 10,275,980 B1
(45) Date of Patent: Apr. 30, 2019

(54) SYSTEM, APPARATUS AND METHOD FOR CONTROLLING WAGERING EVENT INTEGRITY

(71) Applicant: IGT GLOBAL SOLUTIONS CORPORATION, Providence, RI (US)

(72) Inventors: Bradford Heathcote, Chepachet, RI (US); Aaron Michael Koll, Lincoln, CA (US); Sarah W. Simpkins, Warwick, RI (US)

(73) Assignee: IGT Global Solutions Corporation, Providence, RI (US)

( * ) Notice: Subject to any disclaimer, the term of this patent is extended or adjusted under 35 U.S.C. 154(b) by 0 days.

(21) Appl. No.: 15/624,386

(22) Filed: Jun. 15, 2017

Related U.S. Application Data

(60) Provisional application No. 62/350,488, filed on Jun. 15, 2016.

(51) Int. Cl.
*G07F 17/32* (2006.01)
*G07F 17/42* (2006.01)

(52) U.S. Cl.
CPC ..... *G07F 17/3227* (2013.01); *G07F 17/329* (2013.01); *G07F 17/3258* (2013.01); *G07F 17/42* (2013.01)

(58) Field of Classification Search
None
See application file for complete search history.

(56) References Cited

U.S. PATENT DOCUMENTS 7,627,497 B2 12/2009 Szrek et al.
2003/0003984 A1* 1/2003 Petruzzi ..... A63F 3/081 463/17
2003/0120381 A1* 6/2003 Perin, Jr. ..... G07F 9/026 700/232
2004/0023711 A1* 2/2004 Knapp ..... A63F 3/0665 463/17
2004/0193464 A1* 9/2004 Szrek ..... G06Q 20/202 705/24
2004/0209665 A1* 10/2004 Walker ..... A63F 3/061 463/17
2005/0194741 A1 9/2005 Kowell
2009/0101714 A1* 4/2009 Weyler, III ..... G07F 17/32 235/385
2009/0186680 A1* 7/2009 Napolitano ..... G07F 17/32 463/17
2011/0165933 A1* 7/2011 Guziel ..... A63F 3/0645 463/17
2016/0093137 A1* 3/2016 Gaddy ..... G07F 17/329 283/94
2016/0210808 A1* 7/2016 Giunti ..... G07F 17/329

FOREIGN PATENT DOCUMENTS

WO WO/2001/03785 1/2001

* cited by examiner

*Primary Examiner* — Tramar Harper
(74) *Attorney, Agent, or Firm* — Neal, Gerber & Eisenberg LLP

(57) ABSTRACT

A lottery host, retailer terminal(s) and specially adapted tickets and ticket packs provide embodiments of a wagering event integrity control system, method and apparatus as disclosed. In various embodiments, purchased but unactivated tickets for a lottery drawing are activated based upon a code and/or signal received by the lottery host, wherein the received code and/or signal is associated with different tickets in the ticket pack.

19 Claims, 9 Drawing Sheets

SYSTEM, APPARATUS AND METHOD FOR CONTROLLING WAGERING EVENT INTEGRITY

PRIORITY CLAIM

This application claims the benefit of and priority to U.S. Provisional Patent Application No. 62/350,488, filed on Jun. 15, 2016, the contents of which are incorporated herein.

BACKGROUND

The present disclosure relates generally to lottery systems, and more particularly to lottery systems, methods and devices for draw-based games.

Lottery games that are determined by pre-printed indicia and random drawings are known. For example, instant lottery tickets typically provide a scratch-off coating whereby a user can scratch off the coating to determine if the underlying indicia result in any winnings. When instant tickets are made available for sale, they are generally provided to a retailer in packs, and an activation code or number can be read by, or entered through, a terminal to activate the pack of tickets for sale and play. Once the pack is activated, the individual tickets in the pack can be sold without requiring any further activation for the tickets to be played and redeemed. When a ticket purchaser seeks to redeem a purchased instant ticket, a validation code, such as a void-if-removed number ("VIRN"), can be scanned at a retailer POS terminal or other terminal to confirm that the ticket is a winner, and the scanned code is communicated to a lottery host, which checks the code against a database of stored ticket information and returns a message to the retailer terminal that the code is valid to allow the retailer to redeem the ticket for its associated winnings.

Online or draw-based games, including raffle games, allow a user to select various indicia such as numbers, or have the numbers randomly selected for the user, and then a random drawing determines if the user's indicia match enough of the randomly drawn indicia for the user to win. With draw-based games, special drawing game devices or terminals separate from standard retailer point-of-sale (POS) terminals are generally employed to process wagers and print tickets and/or receipts with the player's requested or randomly selected indicia. These special devices may be positioned away from traditional checkout lines and POS terminals, such that players who may be shopping for other items must make a second stop at the special device to make a wager for a draw-based game. Regardless, the special terminal communicates the wager and associated details to a host as part of registering the wager. The game's integrity is maintained, at least in part, by ensuring that only purchased tickets with registered wagers are capable of winning when the random drawing occurs.

Pre-printed draw-based lottery tickets are not common, but as with traditional draw-based lottery tickets, the operator of the lottery must know the indicia or set of indicia tied to tickets that were actually purchased in order to register those tickets as eligible to win. If not all of the pre-printed tickets have been sold, then any unsold tickets must not be included in determining winners in order to maintain the integrity of the wagering game. While a pack of pre-printed draw-based lottery tickets can be activated for sale, such activation cannot be treated as an instant ticket pack activation would be, where each individual ticket is thereafter redeemable by scanning a validation code, since unscrupulous individuals may seek out unpurchased, but winning, draw-based tickets after a drawing has occurred. Accordingly, draw-based lottery tickets with pre-printed indicia must be purchased, and the purchase recorded before the drawing, in order for the ticket to be activated for play and later redemption.

While a code can be provided on a pre-printed draw-based ticket for scanning in order to activate and/or register the ticket for play, problems arise if the activation for play code is not scanned or otherwise entered and communicated to the host. For example, if a purchaser buys a pre-printed draw-based ticket and it is somehow not scanned, it may include winning indicia but not be redeemable, since it would be treated by the system as an unsold ticket. Post-purchase ticket scanning can be missed for many reasons, such as through poor retailer clerk training or by mistake, such as in instances where the player is purchasing several consecutive tickets in a pack, and one or more of the tickets is mistakenly missed during scanning to activate the tickets for play. There is thus a technical challenge with pre-printed draw-based lottery tickets to ensure that all purchased tickets are activated for play, even when the ticket code has not been scanned or otherwise communicated to the host. This challenge is heightened by the desire to reduce the equipment footprint of lottery machines in retailer sites such that all required operations can be fulfilled using retailer POS terminals.

BRIEF SUMMARY

The present disclosure relates generally to a system, apparatus and method wherein wagering event integrity is controlled using, for example, one or more of a remote lottery host, retailer terminal(s) and specially adapted tickets and ticket groups.

According to the present disclosure, pre-printed draw-based lottery tickets are provided in a pack and/or sequence. Each ticket in the pack includes a unique trigger code which, when read or entered at a retailer terminal, activates the individual ticket for play. A lottery host in communication with one or more retailer terminals receives a signal from the retailer terminal corresponding to the unique trigger code of a currently available ticket, determines whether any previous tickets in the pack have not been activated for play, and then activates such previous tickets as well as the currently available ticket for play prior to the lottery game drawing.

Further according to the present disclosure, an input device in communication with one or more retailer terminals permits a user to enter a unique ticket number associated with a specific ticket from the ticket pack. Upon receiving a signal from the retailer terminal corresponding to the unique ticket number, the lottery host determines whether any previous tickets in the pack have not been activated for play, and then activates such previous tickets for play prior to the lottery game drawing.

DETAILED DESCRIPTION

The presently disclosed subject matter now will be described more fully hereinafter with reference to the accompanying drawings, in which some, but not all embodiments of the presently disclosed subject matter are shown. Like numbers refer to like elements throughout. The presently disclosed subject matter may be embodied in many different forms and should not be construed as limited to the embodiments set forth herein, but is applicable to any system, method and/or apparatus wherein an event provider, operator, retailer and/or player experiences improved event integrity through, in part, employing safeguards to ensure that non-activated products that should be activated and/or tracked are appropriately triggered. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

Example embodiments such as those disclosed herein can be used to support regulated state or governmental lotteries, private gaming corporations, or other entities that provide legal gaming to customers. While the examples are described principally with reference to regulated state lotteries, it will be appreciated that the same solutions may be applied in other wagering or regulated gaming applications. The example embodiments described below include references to a lottery host or a host system. A host or host system may be implemented as a single computing system or as a collection of computing systems or subsystems which are communicatively coupled, and each component or subsystem of the exemplary host can be implemented in hardware, software or a combination thereof.

According to various embodiments, the present disclosure describes a wagering event integrity control system, device and method which can enable wagering event providers, operators and associated retailers to offer a securely integrated, ticket-based wagering event to wagering event consumers. In various embodiments, the ticket-based wagering event can relate to a game that includes a first game, such as an instant win game, combined with a subsequent event-based game, such as a drawing-based game.

Figure 1:
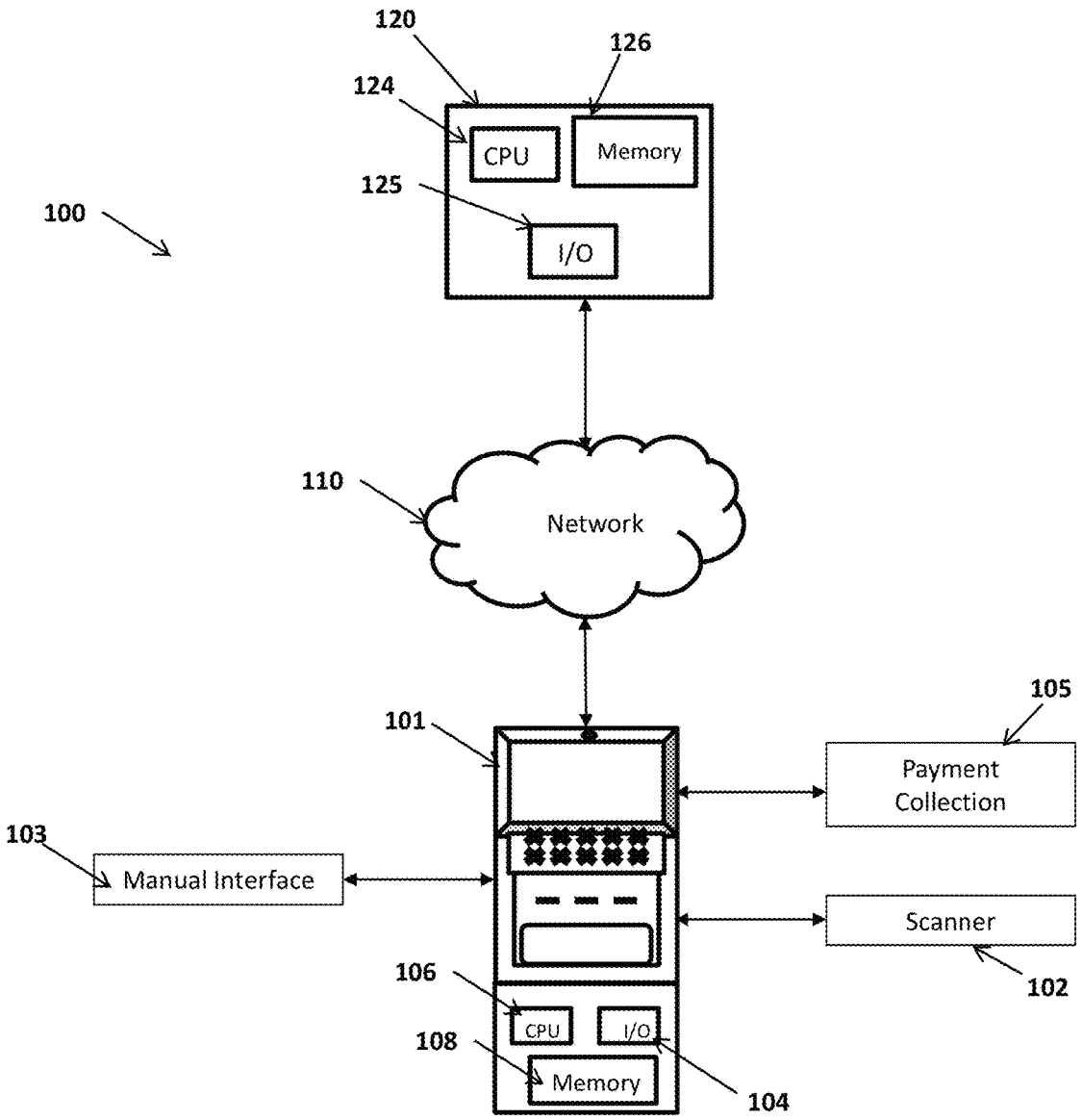
FIG. 1 is a schematic illustrating an exemplary wagering event integrity control system according to certain embodiments of the present disclosure.

FIG. 1 illustrates a wagering event integrity control system 100 according to various embodiments of the present disclosure. In various embodiments, control system 100 includes one or more retailer terminals (e.g., terminal 101) incorporating and/or in communication with a scanner device 102. Each retailer terminal 101 can be configured to communicate and receive activation codes associated with certain product inventory using, among other things, the scanner 102, or a manual input interface 103 (e.g., a key pad, mouse, trackball, touch pad, microphone, joystick, game pad, voice recognition device, toggle switch, pushbutton, gesture based motion detection device or the like visual interface and/or touch screen interface in retailer terminal 101). According to various aspects, the retailer terminal 101 can have or be in communication with a payment collection apparatus 105, a display 107 and a ticket dispenser tray. The payment collection apparatus 105 can process cash, credit, debit, cashless, ticket-based, loyalty reward/redemption and other forms of payment, for example. Such apparatus 105 can be provided in the form of one or more bill collectors, coin collectors, magnetic stripe readers, chip readers, RFID tag readers and other known devices for receiving and processing payments.

While the retailer terminal 101 can be embodied in a clerk-operated point-of-sale (POS) terminal, it may also take the form of a player self-service terminal or computing device in appropriate commercial sites, subject to any jurisdictional limitations, for example. It will be appreciated that the terminal(s) 101 can incorporate necessary processing power in the form of one or more central processing units (CPU) 106, an input/output (I/O) interface 104 and memory 108 for storing data and programming that can be employed by the processor to carry out the functions and communications necessary to facilitate the processes and functionalities described herein. Ticket generators (e.g., retail clerks and players) can enter commands and information into respective terminals through a user interface as described above. In addition to display devices, the terminal 101 can also include other peripheral output devices, such as one or more printers, for example, which may be connected through an output peripheral interface.

Figure 2:
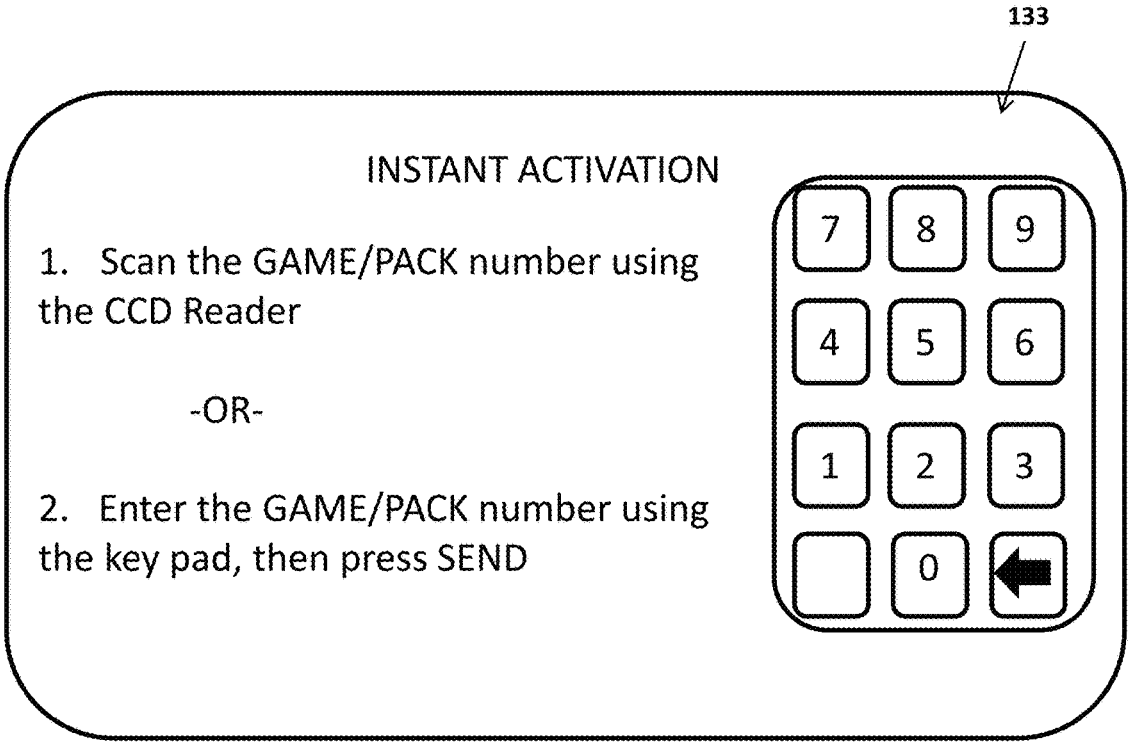
FIG. 2 illustrates an exemplary manual input interface associated with a retailer terminal according to certain embodiments of the present disclosure.

The retailer terminal 101 can also be in communication with a network 110 (e.g., the internet or a private network). The system 100 can also include a remote central controller or lottery host 120. The host 120 is shown in communication with the network 110, and is thereby in operative communication with retailer terminal 101. It will be appreciated that the host 120 can incorporate necessary processing power in the form of one or more central processing units (CPU) 124, an input/output (I/O) interface 125 and memory 126 for storing data and programming that can be employed by the processor to carry out the functions and communications necessary to facilitate the processes and functionalities described herein. It should be understood that, in various embodiments, there may be one or more retailer terminals 101 and/or one or more remote lottery hosts 120, as appropriate. An exemplary embodiment of a user interface 133 associated with the retailer terminal 101 is illustrated in FIG. 2.

In various embodiments, ticket inventory deployed to retailers for ultimate consumption by consumers is managed. In some embodiments, inventory may include, for example, packs containing multiple individual products arranged in a sequence (e.g., packs or rolls of lottery game tickets to be sold individually to consumers) that are delivered from a wagering event provider or operator to one or more retailers. In these various embodiments, when a retailer makes certain inventory available for sale to consumers (e.g., a pack containing one or more tickets for sale to consumers), the retailer can "activate" the pack. Pack "activation" may take many forms, including, for example, communicating to the host (e.g., 120) or remote central controller operated by a wagering event provider and/or operator that the pack is being made available for sale. In various embodiments, a retailer can communicate such availability for sale by, among other things, employing one or more retailer terminals (e.g., 101) and associated hardware and software to scan a pack activation code, or to manually enter an activation code. Such codes can be sent directly to the host 120 over the network 110 via the retailer terminal(s) 101, and many forms of communication can be accommodated, including email, phone, and other messaging systems and protocols.

In various embodiments, an operator of a retailer terminal(s) 101 employs a scanner device 102 in communication with the terminal 101 to read a game pack number or activation code from a ticket pack, whereupon programming operating on the retailer terminal automatically communicates such code or number as an activation signal directly to the lottery host, which then receives the activation signal and subsequently renders the associated pack of tickets as activated for sale and/or eligible for individual ticket activation. In other embodiments, the scanned code or number is first converted by the retailer device into a special indicator that is then communicated as the activation signal to the lottery host, which receives the activation signal and subsequently renders the associated pack of tickets as activated for sale and/or eligible for individual ticket activation. The retailer may be prompted for such action as at 135 using interface 133 in FIG. 2. If a ticket is individually activated later as described herein, it becomes registered for play in the next lottery drawing.

In other embodiments, an operator of the retailer terminal can manually enter a code or number into a user interface in communication with the retailer terminal, and the code or number, or translated representation thereof, is then communicated as the activation signal to the lottery host in similar fashion to that described above. The retailer may be prompted for such action as at 137 using interface 133 in FIG. 2. Regardless of embodiment, the code, number or representation thereof can be considered a ticket pack activation signal that activates the ticket pack for sale and/or renders each ticket eligible for individual ticket activation. Such communication can be automatic or can occur after further user interaction, such as the user selecting a "send" or "enter" icon or key on a user interface as part of, or in communication with, the retailer terminal. In various embodiments, the code or number employed to activate the ticket pack is applied to a substrate at the beginning of the roll of tickets, and takes the form of a ticket that is not actually usable as an individual ticket. In other words, in embodiments where a ticket roll or pack is employed, the activation ticket can appear first in the roll, ahead of the first actual ticket for a wagering event, and then subsequent tickets for the wagering event appear in sequence thereafter. In various embodiments, a pack termination ticket is also provided after the last available ticket for the wagering event at the end of the roll or pack. The pack termination ticket can include a second "activation" code that, when read, indicates that the full pack of tickets has been sold, and each ticket has been or is to be activated, as described elsewhere herein. In other embodiments, the activation code or number is presented on the ticket packaging, or on an insert within the packaging for the ticket pack. In various other embodiments, a unique ticket number from a ticket in the pack can be read or entered via the retailer terminal which then communicates an activation signal to the lottery host to activate the ticket pack for sale and/or render each ticket in the pack as eligible for individual ticket activation.

Whether the lottery host receives a pack activation signal that is the actual code or number scanned, a representation of the scanned code or number, or one of the unique ticket numbers on a ticket in the pack, the lottery host operates programming stored in memory to activate the tickets in the ticket pack for sale. Activating the tickets for sale makes the tickets eligible to be scanned in order to be activated for play. In other words, even though the ticket pack is activated for sale, each individual ticket is not activated for play until its own activation code or number has been independently scanned, read or otherwise entered via the terminal 101 and acknowledged by the lottery host 120.

Figure 3:
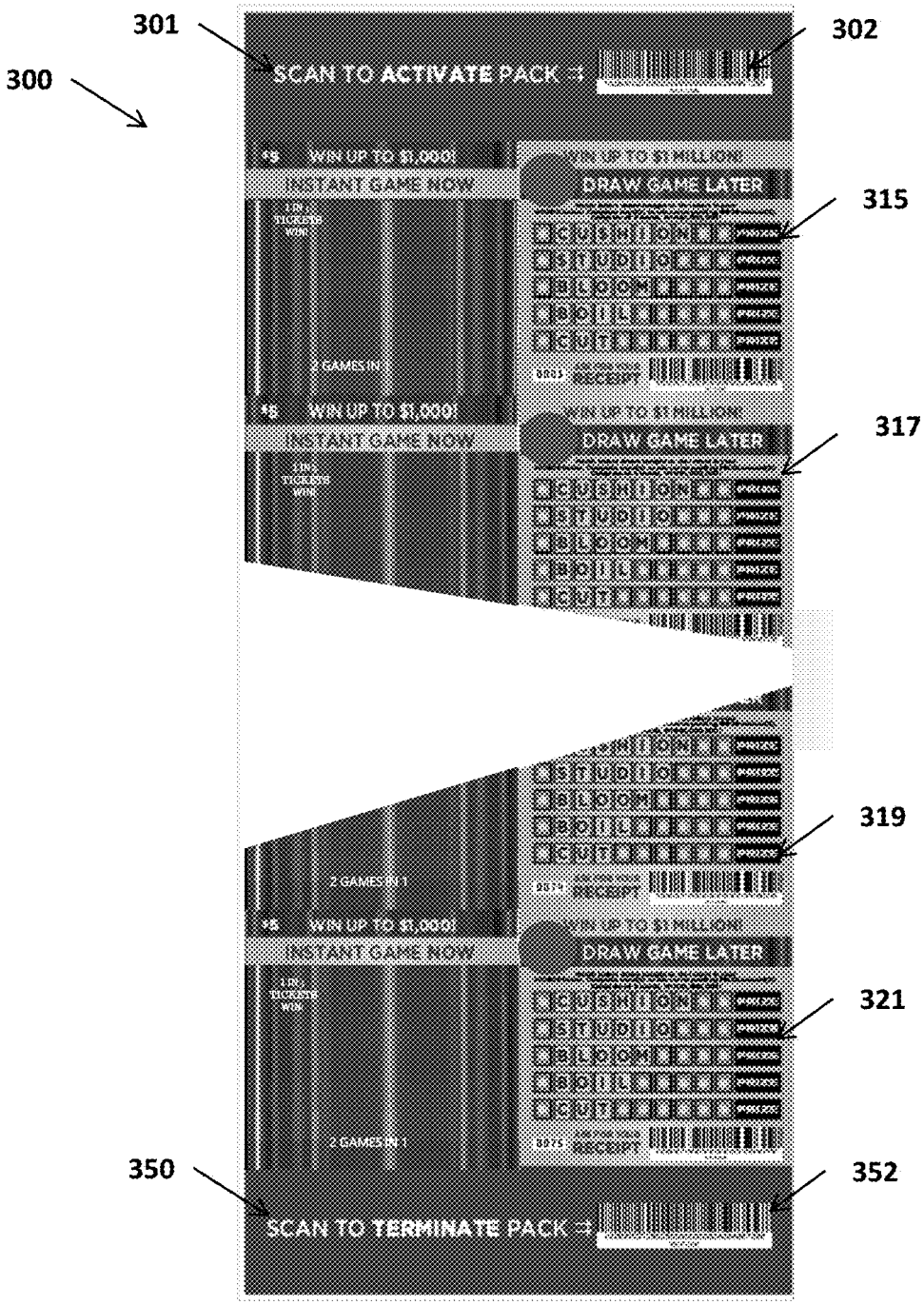
FIG. 3 illustrates an exemplary game ticket pack according to certain embodiments of the present disclosure.

FIG. 3 illustrates an exemplary embodiment of a game ticket pack with an activation ticket 301 that can be used to activate the ticket pack 300 and/or render game tickets 315, 317, 319 and 321 in the pack as eligible for individual activation. As described elsewhere herein, a retailer can scan an activation code 302, such as a bar code, on the activation ticket 301 using the scanner 102. A number printed on the activation ticket 301 may also be manually entered into the system 100 using, for example, the manual input interface 103. Upon scanning the activation code 102 (or manually entering the number), the system 100 operates to "activate" the ticket pack and/or render the ticket pack as eligible for individual ticket activation. As described above, such activation can occur through automatic communication of an activation signal in the form of the scanned code or manually entered code/number from the retailer terminal to the lottery host. The host can internally acknowledge from the receipt of the activation signal that the associated ticket pack is activated and individual tickets in the pack are eligible for individual activation. The lottery host 120 and/or system 100 can then place the ticket pack and/or inventory associated with the unique activation indicator in an "active" mode. The now "active" inventory (e.g., tickets in gaming ticket pack 300) may then be sold to consumers by the retailer.

In addition to storing game pack numbers and associated activation signals, the lottery host 120 stores details about the individual tickets in the pack. Each ticket can be printed with game indicia, activation indicia, validation indicia, artwork, instructions, opaque material, clear material, scratch-off material and other desired elements. Content, data, design elements and other items to be printed on the substrate can be generated by a computer system operating programmed instructions stored in a memory. In various embodiments, the data for multiple games are printed on a given individual substrate. The substrate is perforated or scored in order to permit individual game tickets to be removed from the pack, roll or sheet of tickets. In various embodiments, a unique trigger code, game play indicia, a unique ticket number and a unique game validation code are printed on each individual ticket in the pack, and these elements are stored by the lottery host and associated with the unique ticket number for each ticket. As it cannot be known when the tickets will be purchased, no draw date is initially assigned to any of the tickets.

In various embodiments, the system disclosed herein controls and acknowledges when deployed ticket inventory has been sold in its entirety. For example, a game provider and/or operator can be alerted that a given amount of inventory (e.g., gaming ticket pack 300) has been fully sold. In some embodiments, gaming ticket pack 300 includes termination ticket 350, which can include a termination code 352, a number or other termination indicator. In some embodiments, following the sale of the last available ticket 321 in a pack 300 associated with a certain inventory, termination ticket 350 can be processed in a manner similar to activation ticket 301. For example, a retailer can scan the termination bar code 352 included on termination ticket 350 using the scanner 102.

When a ticket is presented for redemption, the unique validation code on the ticket is read or entered into the retailer terminal 101, and communicated to the lottery host. The host then retrieves the ticket data associated with the unique validation code to ensure that the ticket has been activated for play and to determine what prize is associated with the game indicia. Should the validation process determine that the validation code is valid and/or authentic, the host 120 communicates with the terminal that the code is approved, and the retail clerk and/or self-service terminal can pay any associated winnings to the player.

In various embodiments, even though a ticket pack may be activated, the individual tickets in the pack may not be activated. Thus, the holder of a ticket, purchased or not, that has not been activated cannot redeem the ticket for any prize that may have been won, even if the ticket is part of a pack that has been activated for sale. As disclosed, the integrity of wagering game events is controlled, in part, by requiring individual ticket activation in addition to ticket pack activation.

Figure 4:
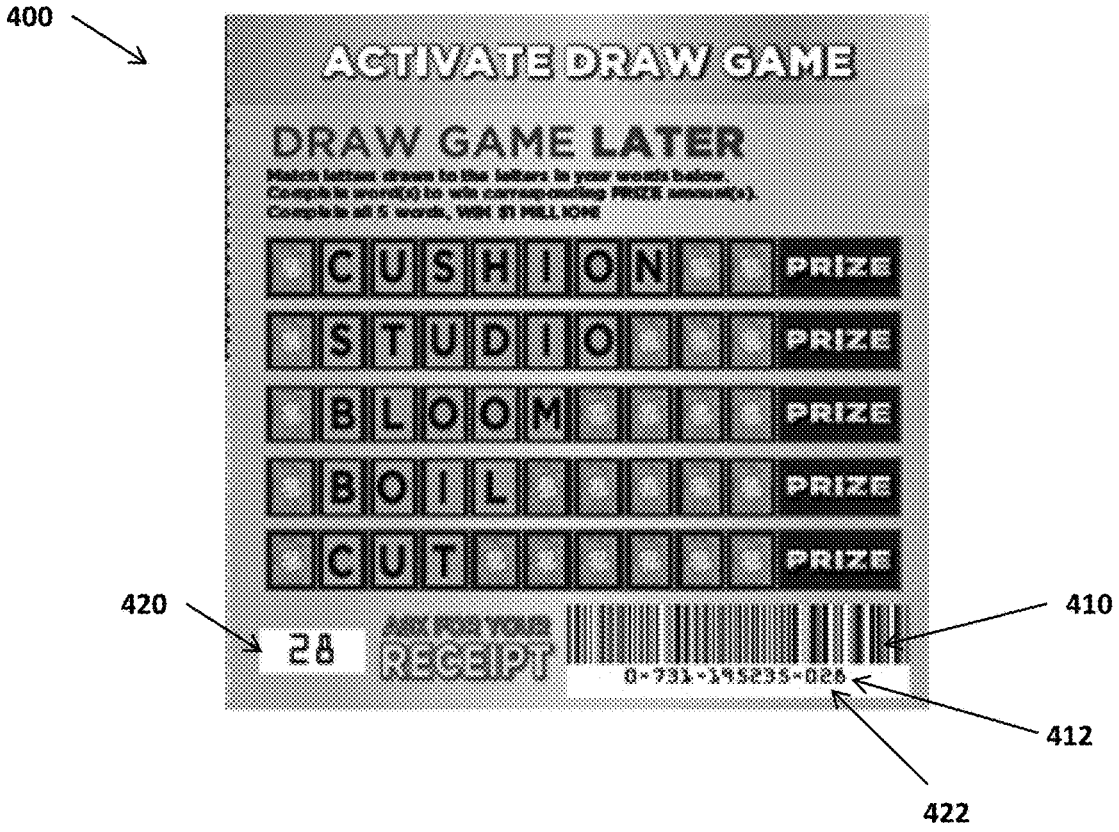
FIG. 4 illustrates an exemplary game ticket according to certain embodiments of the present disclosure.

In various embodiments, for example, sale of an individual game ticket (e.g. game ticket 400 in FIG. 4) is required before the ticket can be made eligible for, for example, a particular wagering event such as a drawing to be held at a later time (e.g., the evening of the day of sale).

In various embodiments, a retailer "triggers" an individual game ticket 400 to be activated for play at the time of sale to a consumer. In some embodiments, the retailer can trigger the game ticket 400 by scanning a trigger validation bar code 410. The retailer can scan the trigger validation bar code using, for example, scanner 102. Alternatively, the retailer can manually enter a ticket product code 412 contained on the ticket (e.g., under the trigger validation bar code 410) into the manual interface 103 of retailer terminal 101. The trigger validation bar code 410 is a bar code representation of the alphanumeric characters in the ticket product code 412, such that both codes 410, 412 represent the same information. A trigger code that is unique to each ticket, such as the trigger validation bar code 410, the ticket product code 412, or a representation of the bar code 410 or product code 412 as generated by the retailer terminal, can be communicated from the retailer terminal to the lottery host, either automatically or through manual interaction as described above. The ticket 400 can also include a ticket number 420 that is unique to each ticket, which typically is a number referencing the order in which the ticket appears in the sequence of tickets provided in the ticket pack. In various embodiments, the ticket product code 412 can include a visual representation of the ticket number (as at 422) as part of the ticket product code 412, and the trigger validation bar code 410 can include a bar coded representation of the ticket number. It will be appreciated that the ticket number representation 422 on the ticket product code may be the only instance of the ticket number visually appearing on the ticket, or the ticket number may be separately shown in additional instances such as at 420.

Figure 5A:
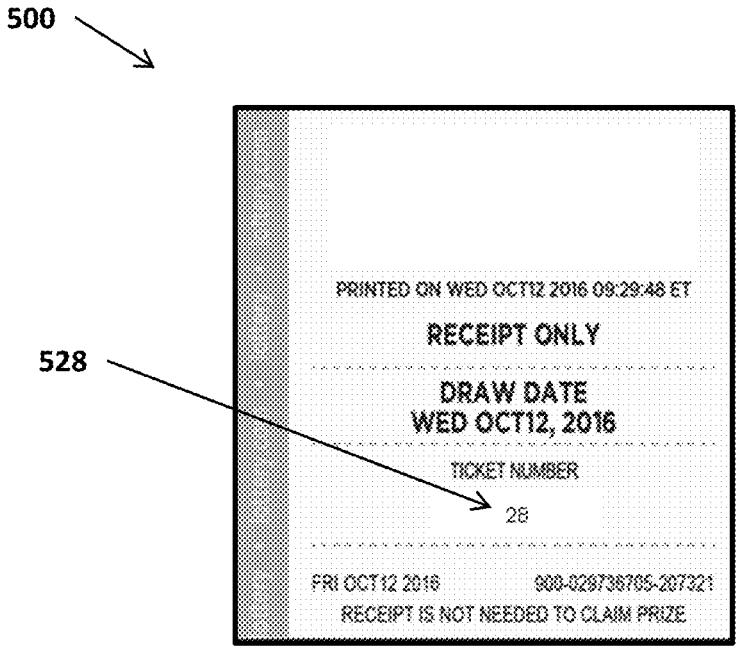
FIG. 5A illustrates an exemplary customer receipt according to certain embodiments of the present disclosure.
Figure 5B:
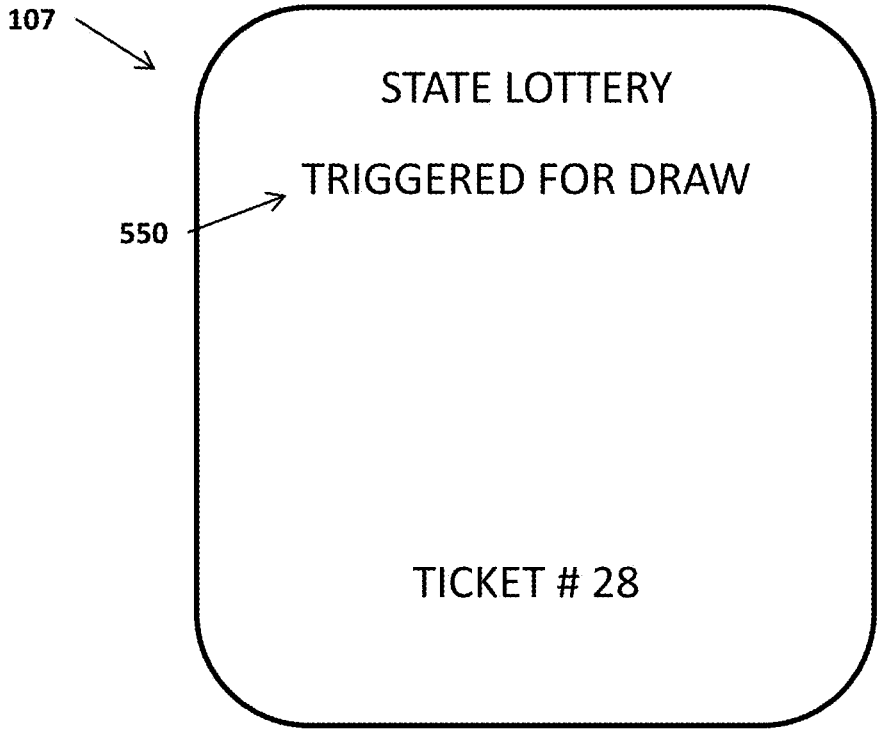
FIG. 5B illustrates an exemplary triggering message on an exemplary user interface according to certain embodiments of the present disclosure.

In various embodiments, upon the retailer terminal triggering a ticket and the host receiving the corresponding ticket activation signal from the retailer terminal, the ticket becomes "active" and/or registered for the next game event (e.g., a daily evening drawing associated with a particular game). The consumer can also be advised by the system 100 at the time of sale that the ticket is "active" for the game event to be held at a certain date/time. Such activation and assigned drawing/draw date is also stored in the lottery host's database of ticket information and associated with the triggered ticket. In some embodiments, a receipt is issued from device 101 to the consumer, indicating the associated game event details. An exemplary embodiment of such a receipt 500 is shown, for example, in FIG. 5A, indicating that ticket number 28 (identified at 528) is eligible for the drawing to be held on "OCT12, 2016." A similar "triggered for draw" message 550 including similar information can also be produced on a visual display 107 associated with the retailer terminal, as illustrated in FIG. 5B. In some embodiments, the "triggered for draw" message 550 shown on retailer terminal display 107 can be customer facing.

In some embodiments, there may be instances where a gaming ticket is sold by a retailer to a consumer but the ticket is not, for whatever reason, properly activated. In such scenarios, it may be possible for a consumer to purchase a ticket that is not initially activated properly, risking the result that the ticket sold is outside of the pool of tickets considered for an upcoming wagering event (e.g., a drawing).

Embodiments of the presently disclosed system, method and apparatus include one or more mechanisms to mitigate against the risk of tickets being sold without being properly activated ahead of the associated wagering event (e.g., a drawing). In some embodiments, the system is configured to "auto-trigger" previously sold but "untriggered" tickets upon triggering of a subsequent ticket in the sequence of tickets, or upon other operations as described herein.

Figure 6:
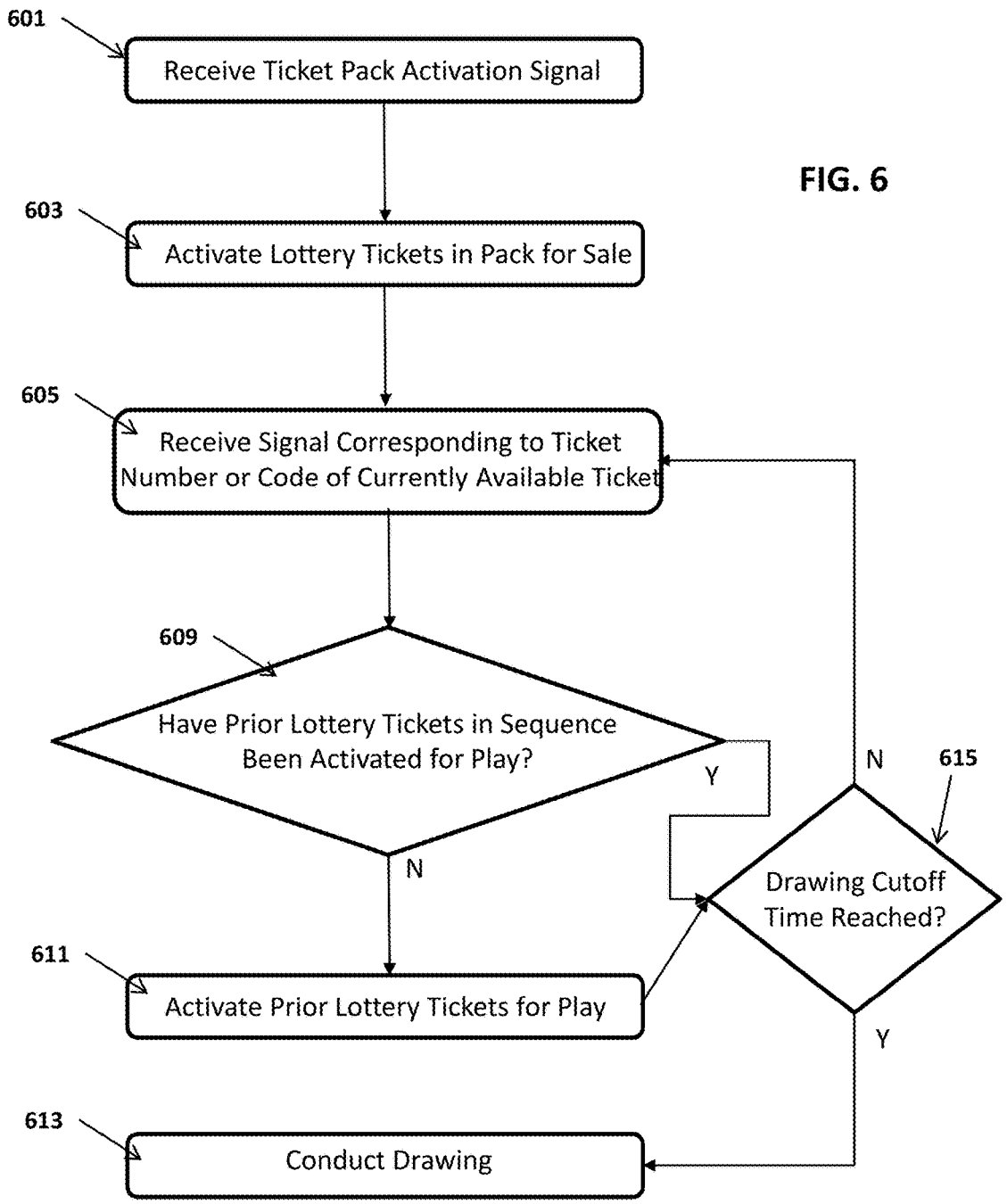
FIG. 6 is a flow diagram illustrating process steps in accordance with embodiments of the present disclosure.

FIG. 6 is a sample process flow illustrating aspects of the present disclosure. As shown therein, and as at step 601, the lottery host receives a ticket pack activation signal from a retailer terminal. As at step 603, the lottery host activates the ticket pack such that individual tickets in the pack are available for sale and may be activated for play. As described elsewhere herein, the tickets in the ticket pack each include a unique trigger code, a unique ticket number and game indicia for participation in a draw-based lottery game. The game indicia can be pre-printed on the lottery ticket. Further, the tickets are arranged in a sequence within the ticket pack, which may generally be with sequential ticket numbers, such that ticket #33 will be sold before ticket #34 but after ticket #32, for example. Regardless of numbering scheme, the lottery host stores the unique trigger code, ticket number and game indicia for each of the tickets, and maintains information on the sequence in which the tickets are made available for sale. As at step 605, and optionally in embodiments where the lottery host has received a first signal in the form of an activation signal for the ticket pack, the lottery host receives a second signal corresponding to either the unique trigger code or the unique ticket number of the currently available ticket. In various embodiments, if the currently available ticket is being purchased, such as by payment being received at or by the retailer terminal, for example, the lottery host will receive the second signal in the form of the unique trigger code, or a representation thereof, from the retailer terminal. In such instances, the lottery host will also activate the currently available lottery ticket for play and assign it to a drawing/draw date that is typically the next scheduled drawing. In various other embodiments, such as described in connection with FIG. 8 below, the lottery host will receive the second signal in the form of the unique ticket number of the currently available ticket at a time when the currently available ticket has not yet been sold.

As at step 609, based on the received second signal, the lottery host determines whether prior lottery tickets in the sequence have been activated for play. For example, if the second signal pertains to ticket #33, and the last recorded sale of a ticket in the pack is for ticket #22, the lottery host may determine that a first subset of the tickets (e.g., tickets #1-22) has been sold and activated prior to the lottery host receiving the second signal, but that a second subset of the prior lottery tickets (e.g., tickets #23-32) has not been activated for play. For the subset of prior tickets determined to be unactivated, the system presumes such tickets have been sold, and as at step 611, the lottery host activates those tickets for sale, without requiring any direct scan or reading of the actual prior sold lottery tickets. In this way, the holders of purchased tickets #23-32 are now eligible to win prizes in the drawing, whereas if their tickets had remained unactivated, they would not be eligible to win prizes in the drawing. If the prior tickets have been activated for play, or once any unactived purchased tickets have been activated for play, then as at step 615, the lottery host determines if the lottery drawing ticket sale cutoff time has been reached, and if so, then as at step 613, the lottery host can conduct the drawing with the understanding that all purchased tickets have been activated and are eligible to win. If the cutoff time has not been reached, then the lottery host is still available to receive a different second signal associated with whatever lottery ticket is currently available at that time, as at step 605.

Figure 7:
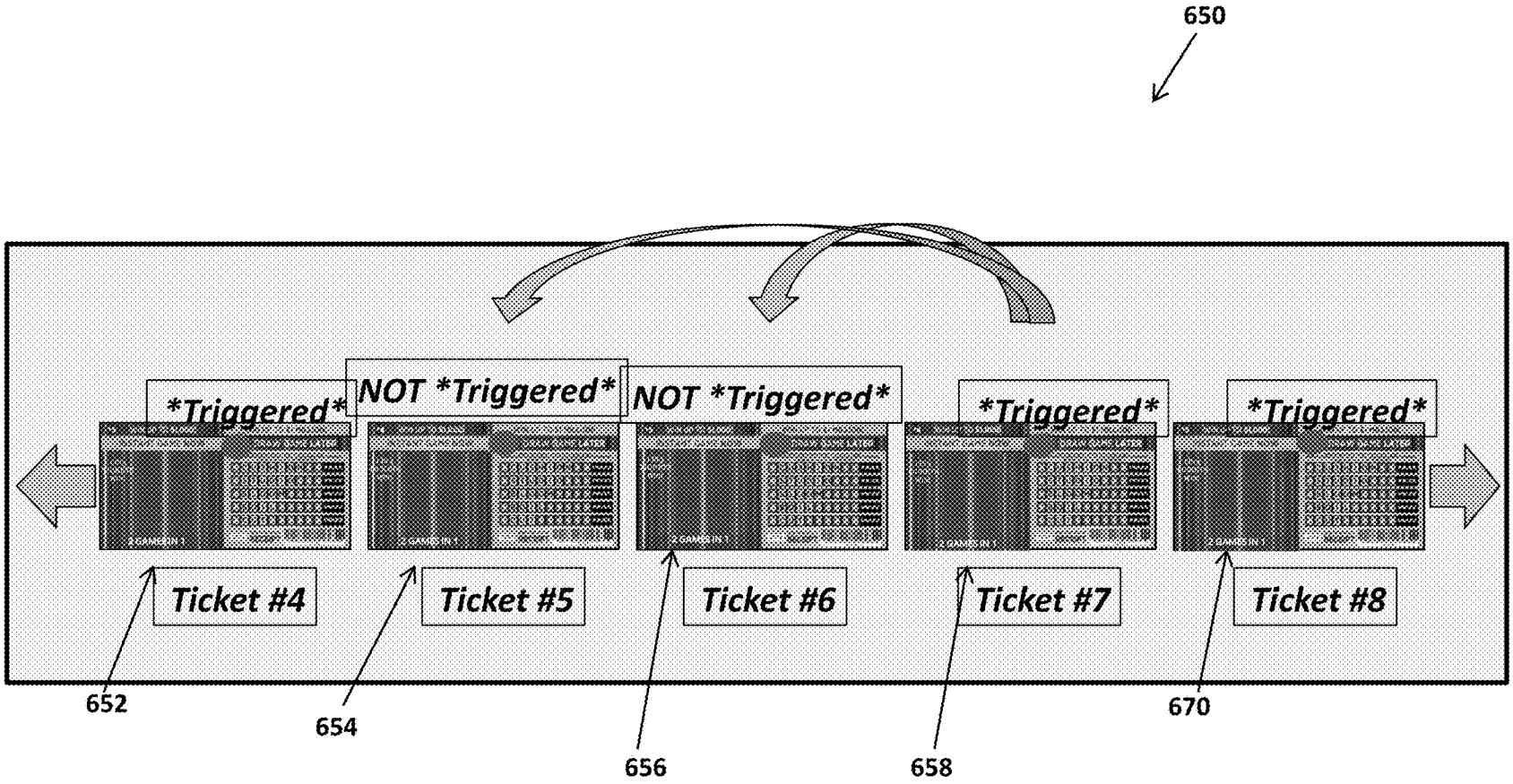
FIG. 7 is an exemplary flow diagram illustrating an "auto-trigger" aspect according to certain embodiments of the present disclosure.

FIG. 7 is a diagram 650 illustrating an exemplary embodiment of the "auto-trigger" aspect described above and elsewhere herein. The exemplary embodiment illustrated in FIG. 7 includes, among other things, a series of exemplary individual game tickets 652, 654, 656, 658, and 670 that are in sequence as part of a pack, wherein the pack has been activated such as described above, but certain individual tickets have not been activated. In the example shown in FIG. 7, the retailer has sold "Ticket #4" (652) and triggered it properly. The retailer failed, however, to properly trigger "Ticket #5" (654) or "Ticket #6" (656) upon each respective sale. Accordingly, absent further intervention by the game administrator or the retailer, sold Ticket #5 (654) and Ticket #6 (656) are not "active," for example, for the game event (e.g. drawing) intended. Thus, at this point, if either of tickets 654 or 656 would be a winner based on the wagering event results, the tickets would not be redeemable. Such outcomes would be highly undesirable.

As disclosed herein, however, the system, method and apparatus can be configured to "auto-trigger" Ticket #5 (654) and Ticket #6 (656) upon the sale and triggering of Ticket #7 (658). More particularly, in various embodiments, the system, method and apparatus can be configured to recognize that Ticket #7 (658) was "triggered" even though Ticket #5 (654) and Ticket #6 (656) were not triggered. The presently disclosed system, apparatus and method can, therefore, automatically trigger the tickets 654, 656 not properly triggered by the retailer, thus activating these tickets 654, 656 for the upcoming game event (e.g., drawing). In this way, embodiments of the present disclosure overcome a technical challenge presented by not having the unscanned tickets 654, 656 available to be scanned for activation. The game's integrity can be maintained, at least in part, by the host checking prior unactivated tickets upon receipt of the signal for the currently available ticket.

In various embodiments, the presently disclosed system, method and apparatus include certain other mechanisms to ensure proper activation and triggering of tickets sold, where appropriate. For example, while the auto-trigger mechanism discussed hereinabove can trigger and activate untriggered tickets upon the sale of a subsequently triggered ticket, there may be instances where untriggered tickets still remain inactive. One exemplary scenario can occur when the final ticket sold by a retailer prior to a corresponding wagering event (e.g., drawing) is not properly triggered. In such a scenario, there would be no subsequent sale prior to the drawing event that could "auto-trigger" that ticket in accordance with certain embodiments as disclosed above.

Figure 8:
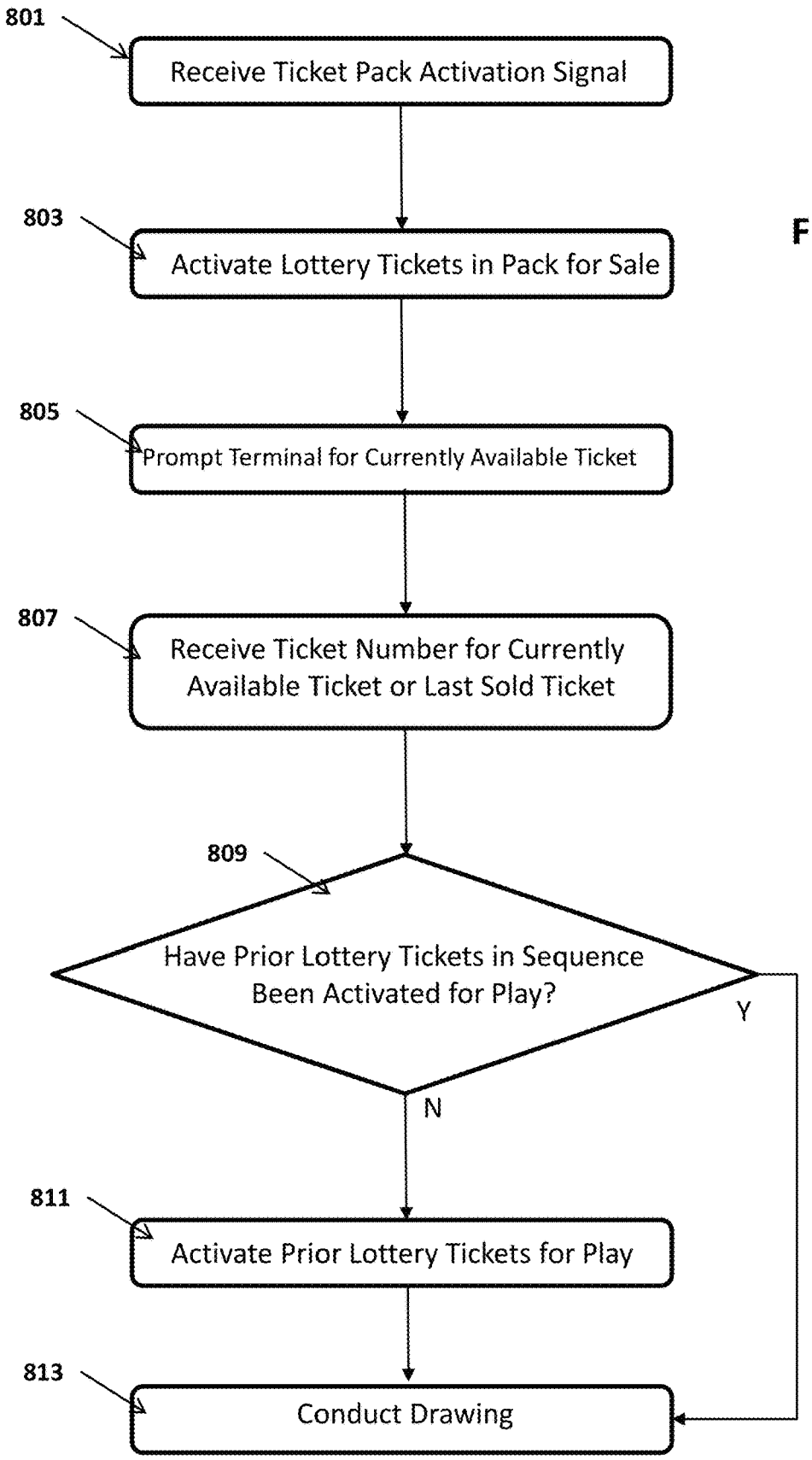
FIG. 8 is a flow diagram illustrating process steps in accordance with embodiments of the present disclosure.

FIG. 8 is a sample process flow illustrating aspects of the present disclosure addressing the above issue, among other things. As shown therein, and as at step 801, the lottery host receives a ticket pack activation signal from a retailer terminal. As at step 803, the lottery host activates the ticket pack such that individual tickets in the pack are available for sale and may be activated for play. As at step 805, the lottery host communicates a message to the retailer terminal, which can take the form of a prompt visually displayed on the terminal display to request verification from the retailer of the specific tickets sold during a game event period. As at step 807, the lottery host receives a communication from the retailer terminal indicating the unique ticket number of the currently available ticket in the ticket pack, wherein the currently available ticket has not yet been sold. In various alternative embodiments, the lottery host may inquire and/or receive the unique ticket number of the last sold ticket in the ticket pack. Regardless of which ticket number is communicated back to the lottery host, the lottery host next determines, as at step 809, whether any, and which, prior lottery tickets in the sequence have been activated for play. If any prior lottery tickets in the sequence have not been activated for play, then the system presumes such tickets have been sold, and as at step 811, activates such tickets for play. Optionally, after step 809 and prior to step 811, the host first issues a prompt to the retailer terminal, seeking confirmation that any untriggered tickets should be activated before proceeding to activate such tickets in step 811. In various embodiments, the prompt from the host to the retailer terminal is issued at the end of a day when a drawing is to occur, as a method of confirming that all tickets that have been sold are activated for play and thus eligible to win a prize in the drawing. In such instances, and once any purchased but unactivated tickets have been activated, the lottery host need not await any further signals to activate additional tickets, but can proceed with the drawing, as at step 813.

Figure 9:
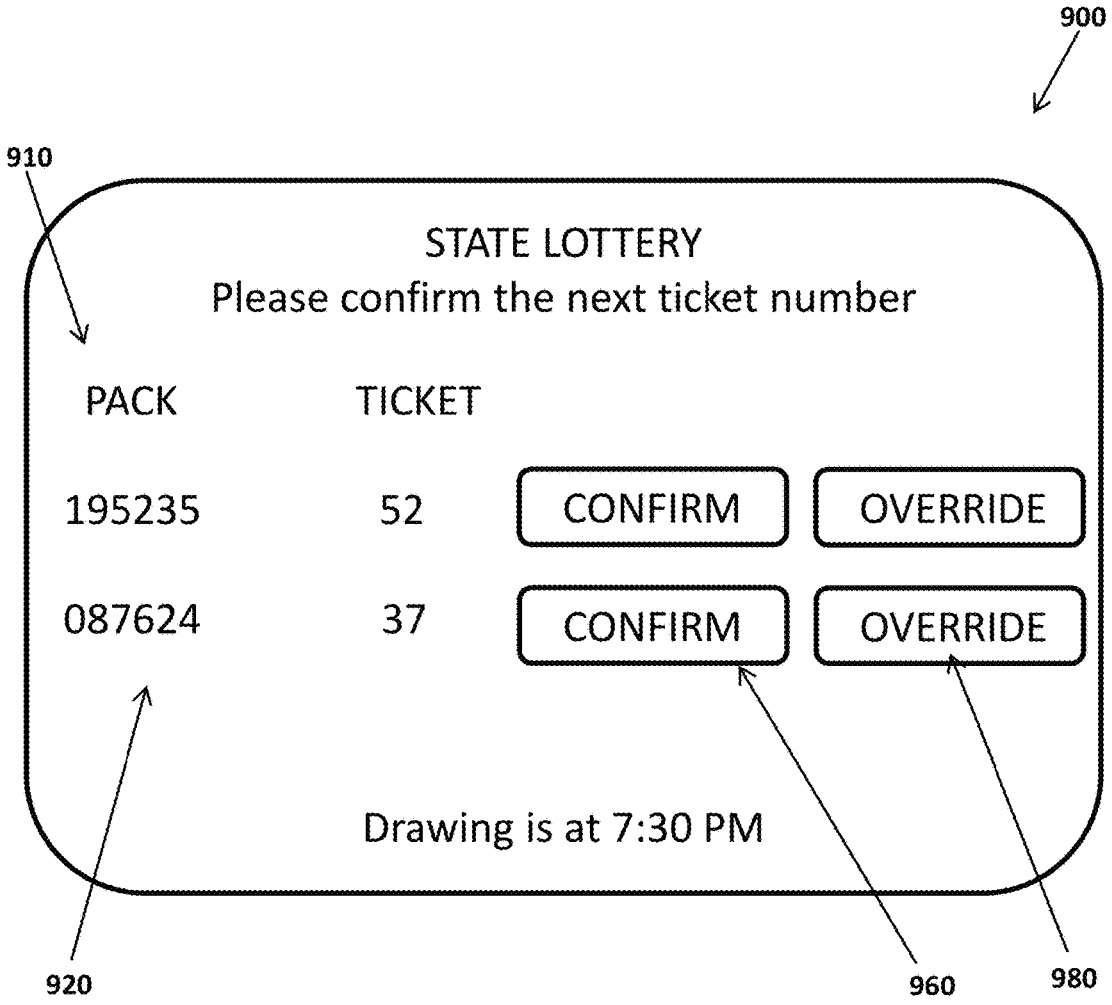
FIG. 9 shows an exemplary user interface illustrating a sample notification according to certain embodiments of the present disclosure.

FIG. 9 illustrates an exemplary user interface 900 that can be employed in some embodiments as a message or prompt from the lottery host 120 to request verification from the retailer of the specific tickets sold during a game event period, as described above. For example, if a wagering event period corresponds to a daily drawing that occurs every evening at, for example, 7:30 PM, there may be a need to confirm all accepted wagers just prior to the drawing. In such event, an end-of-period push notification can push a message 910 from host 120 to retailer interface 101 before the game event (e.g., drawing). As shown, the message 910 prompts the retailer to enter, for example, the pack number and next ticket number available for sale in a given ticket pack (e.g., 300 in FIG. 3). The message 910 can be prepopulated with what the system 100 anticipates should be the next number corresponding to the current ticket pack 300, based on, for example, ticket pack activation/termination data and triggering data entered into the system throughout the corresponding period.

An example according to various embodiments of the presently disclosed system is provided. Assume, for example, that a retailer has properly activated the ticket pack 300 and properly triggered each ticket upon each ticket's respective sale in accordance with the present disclosure. In that exemplary scenario, the end-of-period push notification message 910 might prompt the retailer to simply confirm the next ticket number 920 in the pack 300 (for example, ticket number 52 in pack number 195235 and ticket 37 in pack number 087624 as illustrated at 920 in FIG. 9). In some embodiments, the pack number associated with ticket pack 300 is printed on each individual ticket in ticket pack 300 for reference. In the event this information corresponds to the retailer's inventory, the retailer can confirm the same. In some embodiments, the retailer can confirm such information with the system 100 by clicking a "confirm" button 960 on, for example, the manual input interface 103 or retailer interface 101.

If, however, a ticket sold to a consumer was not properly activated (whether by failure to scan the trigger validation bar code 410 or other anomaly), the retailer can be presented with a message 910 containing an assumed ticket number that does not correspond to the actual next ticket number 420 in the retailer's inventory. In such a scenario, the retailer can "override" the message and manually input the correct value for the next ticket number. For example, retailer may have sold ticket number 52 but failed to properly trigger or activate the ticket, therefore depriving the host 120 of information regarding the sale. In some embodiments, by overriding the message and inputting the correct ticket number available to retailer (e.g., 53), the override input is communicated as an override signal from the retailer terminal to the host, the assumed ticket number is also changed to the actual ticket number in the host database, and the ticket 52 is then automatically activated or triggered by the host and available for the upcoming wagering event (e.g. drawing) associated with the game event period. In some embodiments, a retailer can override the message by clicking an "override" button 980 on, for example, the manual input interface 103 or retailer interface 101, and following prompts to enter the correct value. In this way, embodiments of the present disclosure overcome the technical challenge presented by not having the previously sold but unscanned tickets available to be scanned for activation. The game's integrity can be maintained, at least in part, by the host checking prior unactivated tickets upon receipt of the unique ticket number for the next ticket available to be sold.

In various other embodiments, the push notification is received at the retailer interface after the retailer has closed for the associated period. In such scenarios, the system, apparatus and method of the present disclosure can be configured to allow a retailer to confirm or override the message 910 after the close of the game event period. The host can then activate any untriggered tickets at that time, making them available for the previously executed game event (e.g. drawing) and any associated winnings available to the consumer. Optionally, the host first issues a prompt to the retailer terminal, seeking confirmation that any untriggered tickets should be activated before proceeding to activate such tickets. According to various embodiments, if a retailer closes their store before the end of the day push notification, they will be prompted to enter the next ticket number prior to their first sale the following day.

It will be appreciated that alternatives to the above-described operations for controlling the integrity of wagering events. For example, one or more retailer terminals can be employed to activate a ticket pack and individual tickets, and further to manage push notifications, rather than the lottery host or remote central controller. In such embodiments, the terminal(s) can be provided with programming for recording associated code, number and/or indicator data, and rendering ticket groups or individual tickets as activated based thereupon, for example.

It will be appreciated that all of the disclosed methods and procedures herein can be implemented using one or more computer programs or components. These components may be provided as a series of computer instructions on any conventional computer-readable medium, including RAM, SATA DOM, or other storage media. The instructions may be configured to be executed by one or more processors which, when executing the series of computer instructions, performs or facilitates the performance of all or part of the disclosed methods and procedures.

Unless otherwise stated, devices or components of the present disclosure that are in communication with each other do not need to be in continuous communication with each other. Further, devices or components in communication with other devices or components can communicate directly or indirectly through one or more intermediate devices, components or other intermediaries. Further, descriptions of embodiments of the present disclosure herein wherein several devices and/or components are described as being in communication with one another does not imply that all such components are required, or that each of the disclosed components must communicate with every other component. In addition, while algorithms, process steps and/or method steps may be described in a sequential order, such approaches can be configured to work in different orders. In other words, any ordering of steps described herein does not, standing alone, dictate that the steps be performed in that order. The steps associated with methods and/or processes as described herein can be performed in any order practical. Additionally, some steps can be performed simultaneously or substantially simultaneously despite being described or implied as occurring non-simultaneously.

It will be appreciated that algorithms, method steps and process steps described herein can be implemented by appropriately programmed computers and computing devices, for example. In this regard, a processor (e.g., a microprocessor or controller device) receives instructions from a memory or like storage device that contains and/or stores the instructions, and the processor executes those instructions, thereby performing a process defined by those instructions. Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on a user's computer, partly on a user's computer, as a stand-alone software package, partly on a user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Where databases are described in the present disclosure, it will be appreciated that alternative database structures to those described, as well as other memory structures besides databases may be readily employed. The drawing figure representations and accompanying descriptions of any exemplary databases presented herein are illustrative and not restrictive arrangements for stored representations of data. Further, any exemplary entries of tables and parameter data represent example information only, and, despite any depiction of the databases as tables, other formats (including relational databases, object-based models and/or distributed databases) can be used to store, process and otherwise manipulate the data types described herein. Electronic storage can be local or remote storage, as will be understood to those skilled in the art. Appropriate encryption and other security methodologies can also be employed by the system of the present disclosure, as will be understood to one of ordinary skill in the art.

The invention may be embodied in other specific forms without departing from the spirit or essential characteristics thereof. The present embodiments are therefore to be considered in all respects as illustrative and not restrictive, the scope of the invention being indicated by the claims of the application rather than by the foregoing description, and all changes which come within the meaning and range of equivalency of the claims are therefore intended to be embraced therein.

What is claimed is:

1. A lottery host, comprising:

at least one processor; and a memory storing instructions that, when executed by the at least one processor, cause the at least one processor to perform operations comprising:

receiving a first signal from at least one retailer terminal and, in response to receiving the first signal, activating a plurality of lottery tickets for sale, wherein each of the plurality of lottery tickets comprises a unique trigger code, a unique ticket number and game indicia for participation in a draw-based lottery game, and wherein the plurality of lottery tickets is arranged in a sequence comprising at least a currently available lottery ticket and at least one prior lottery ticket in the sequence;

receiving, from the at least one retailer terminal, a second signal comprising the unique trigger code or the unique ticket number of the currently available lottery ticket, wherein the currently available lottery ticket is currently available for activation for play in the draw-based lottery game; and in response to receiving the second signal, and upon the at least one prior lottery ticket not having been activated for play in the draw-based lottery game, activating the at least one prior lottery ticket for play in the draw-based lottery game, wherein the at least one prior lottery ticket has been sold.

2. The host of claim 1, wherein, upon receiving the second signal, the instructions further cause the at least one processor to activate the currently available lottery ticket for play in the draw-based lottery game.

3. The host of claim 1, wherein, prior to activating the at least one prior lottery ticket for play in the draw-based game, the instructions cause the at least one processor to determine whether the at least one prior lottery ticket has been activated for play in the draw-based lottery game.

4. The host of claim 1, wherein the second signal is received from the at least one retailer terminal upon the currently available lottery ticket being sold.

5. The host of claim 1, wherein the second signal is received from the at least one retailer terminal at a time when the currently available lottery ticket has not been sold.

6. The host of claim 5, wherein the instructions further cause the at least one processor to transmit an assumed ticket number of the currently available lottery ticket to the at least one retailer terminal, and in response to the transmission, receive an override signal from the at least one retailer terminal causing the host to change the assumed ticket number of the currently available lottery ticket to the unique ticket number of the currently available lottery ticket.

7. The host of claim 1, wherein the instructions further cause the at least one processor to perform operations comprising:

determining which of the plurality of lottery tickets have been activated for play in the draw-based lottery game prior to the play of the draw-based lottery game.

8. The host of claim 7, wherein the instructions further cause the at least one processor to perform operations comprising:

sending a request to the at least one retailer terminal for the unique ticket number of the currently available lottery ticket.

9. A system, comprising:

at least one retailer terminal;

a plurality of lottery tickets, wherein each of the plurality of lottery tickets comprises a unique trigger code, a unique ticket number and game indicia for participation in a draw-based lottery game, and wherein the plurality of lottery tickets is arranged in a sequence comprising at least a currently available lottery ticket and at least one prior lottery ticket in the sequence; and a lottery host in networked communication with the at least one retailer terminal, wherein the lottery host comprises at least one processor, and at least one memory device which stores a plurality of instructions, which when executed by the at least one processor, cause the at least one processor to perform operations comprising:

receiving a first signal from the at least one retailer terminal and, in response to receiving the first signal, activating the plurality of lottery tickets for sale;

receiving, from the at least one retailer terminal, a second signal comprising the unique trigger code or the unique ticket number of the currently available lottery ticket, wherein the currently available lottery ticket is currently available for activation for play in the draw-based lottery game; and in response to receiving the second signal, and upon the at least one prior lottery ticket not having been activated for play in the draw-based lottery game, activating the at least one prior lottery ticket for play in the draw-based lottery game, wherein the at least one prior lottery ticket has been sold.

10. The system of claim 9, wherein the second signal identifies the unique trigger code of the currently available lottery ticket, and wherein the instructions further cause the at least one processor to activate the currently available lottery ticket for play in the draw-based lottery game.

11. The system of claim 9, wherein, prior to activating the at least one prior lottery ticket for play in the draw-based game, the instructions cause the at least one processor to determine whether the at least one prior lottery ticket has been activated for play in the draw-based game.

12. The system of claim 9, wherein the second signal corresponds to the unique trigger code of the currently available lottery ticket, and wherein the second signal is received from the retailer terminal upon the currently available lottery ticket being sold.

13. The system of claim 9, wherein the at least one retailer terminal comprises a display, at least one retailer terminal processor, and at least one retailer terminal memory device which stores a plurality of instructions, which when executed by the at least one retailer terminal processor, cause the at least one retailer terminal processor to perform operations comprising displaying the unique ticket number of the currently available lottery ticket on the at least one retailer terminal display after the step of activating the at least one prior lottery ticket.

14. The system of claim 13, wherein the at least one prior lottery ticket comprises a plurality of prior lottery tickets, and wherein a first subset of the plurality of prior lottery tickets is activated prior to the receipt, by the host, of the second signal.

15. The system of claim 14, wherein a second subset of the plurality of prior lottery tickets is not activated prior to the receipt, by the host, of the second signal.

16. The system of claim 13, wherein the host receives an override signal from the at least one retailer terminal to change the displayed unique ticket number of the currently available lottery ticket.

17. The system of claim 9, wherein the second signal identifies the unique ticket number of the currently available lottery ticket at a time when the currently available lottery ticket has not been sold.

18. The system of claim 9, wherein the instructions further cause the at least one processor to perform operations comprising:

determining which of the plurality of lottery tickets have been activated for play in the draw-based lottery game prior to the play of the draw-based lottery game.

19. A computer-implemented method, comprising:

providing a plurality of lottery tickets, each of the lottery tickets comprising a unique trigger code, a unique ticket number and game indicia for participation in a draw-based lottery game, and wherein the plurality of lottery tickets is arranged in a sequence comprising at least a currently available lottery ticket and at least one prior lottery ticket in the sequence;

storing, by a lottery ticket host, the unique trigger code, unique ticket number and game indicia for each of the plurality of tickets;

receiving, by the lottery host from a retailer terminal in networked communication with the lottery host, a signal corresponding to at least the unique trigger code or the unique ticket number of the currently available lottery ticket, wherein the currently available lottery ticket is currently available for activation for play in the draw-based lottery game;

determining, by the lottery host based on the received signal, whether the at least one prior lottery ticket has been activated for play in the draw-based lottery game; and upon the at least one prior lottery ticket not having been activated for play in the draw-based lottery game, activating, by the lottery host, the at least one prior lottery ticket for play in the draw-based lottery game, wherein the at least one prior lottery ticket has been sold.

* * * * *